US007300968B2

(12) United States Patent
Hyunkook

(10) Patent No.: US 7,300,968 B2
(45) Date of Patent: Nov. 27, 2007

(54) FLASH SPINNING SOLUTION AND FLASH SPINNING PROCESS USING STRAIGHT CHAIN HYDROFLUOROCARBON CO-SOLVENTS

(75) Inventor: Shin Hyunkook, Wilmington, DE (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 669 days.

(21) Appl. No.: 10/322,145

(22) Filed: Dec. 18, 2002

(65) Prior Publication Data

US 2004/0119196 A1 Jun. 24, 2004

(51) Int. Cl.
*C08K 5/02* (2006.01)

(52) U.S. Cl. ..... 524/462; 524/464; 524/465; 528/491

(58) Field of Classification Search ..... 524/462, 524/464, 465, 468, 545, 546, 579, 583, 585, 524/587; 528/497, 491
See application file for complete search history.

(56) References Cited

U.S. PATENT DOCUMENTS

| | | | | |
|---|---|---|---|---|
| 3,851,023 A | | 11/1974 | Brethauer et al. | |
| 5,202,376 A | * | 4/1993 | Coates et al. | 524/583 |
| 5,250,237 A | | 10/1993 | Shin | |
| 5,369,165 A | | 11/1994 | Kato et al. | |
| 5,672,307 A | | 9/1997 | Shin et al. | |
| 5,874,036 A | | 2/1999 | Shin et al. | |
| 5,977,237 A | | 11/1999 | Shin et al. | |
| 6,162,379 A | | 12/2000 | Shin et al. | |
| 6,303,682 B1 | * | 10/2001 | Shin et al. | 524/462 |
| 2002/0177649 A1 | * | 11/2002 | Shin et al. | 524/462 |

FOREIGN PATENT DOCUMENTS

| | | |
|---|---|---|
| EP | 0 357 381 A2 | 3/1990 |
| EP | 0 357 381 A3 | 3/1990 |
| WO | WO 01/14620 A1 | 3/2001 |

OTHER PUBLICATIONS

Aldrich Advancing Science, Aldrich Chemical Company (2005-2006), pp. 2191 and 2198.*
Aldrich Advancing Science, Aldrich Chemical Company (2005-2006), pp. 849 and 2418.*

* cited by examiner

*Primary Examiner*—Edward J. Cain

(57) ABSTRACT

A spin fluid for producing plexifilamentary products made of a polyolefin dissolved in a primary solvent of dichloromethane or 1,2-dichloroethylene with a straight chain hydrofluorocarbon co-solvent.

14 Claims, 15 Drawing Sheets

FLASH SPINNING SOLUTION AND FLASH SPINNING PROCESS USING STRAIGHT CHAIN HYDROFLUOROCARBON CO-SOLVENTS

BACKGROUND OF THE INVENTION

1. Field of the Invention

This invention relates to a process for flash-spinning polymeric plexifilamentary film-fibril strands wherein ozone-depleting components are not released to the atmosphere and the process is carried out in a low-flammability atmosphere.

2. Description of the Related Art

Commercial spunbonded products made from polyethylene plexifilamentary film-fibril strands have been produced by flash-spinning from trichlorofluoromethane. However, trichlorofluoromethane is an atmospheric ozone depletion chemical and therefore, alternatives have been under investigation. U.S. Pat. No. 5,672,307 and related patents U.S. Pat. Nos. 5,874,036 and 5,977,237 disclose the use of primary solvents of dichloromethane and trans-1,2-dichloroethylene with various co-solvents Nevertheless, the need continues to develop additional spin fluids that are effective for flash spinning and do not deplete the ozone layer.

SUMMARY OF THE INVENTION

This invention is a spin fluid comprising (a) 5 to 30 wt. % synthetic fiber-forming polyolefin, (b) a primary solvent selected from the group consisting of dichloromethane and 1,2-dichloroethylene, and (c) a co-solvent selected from the group consisting of straight chain hydrofluorocarbons and their isomers, the co-solvent having (i) 3 to 4 carbon atoms, (ii) an atmospheric boiling point between 10 and 50° C. and (iii) a molecular weight of less than 219, with the co-solvent present in an amount sufficient to raise the cloud point pressure of the spin fluid by at least 50 pounds per square inch.

The invention is also a process for the preparation of plexifilamentary film-fibril strands of synthetic fiber-forming polyolefin which comprises:

generating a spin fluid of (a) 5 to 30 wt. % synthetic fiber-forming polyolefin, (b) a primary solvent selected from the group consisting of dichloromethane and 1,2-dichloroethylene, and (c) a co-solvent selected from the group consisting of straight chain hydrofluorocarbons and their isomers, the co-solvent having (i) 3 to 4 carbon atoms, (ii) an atmospheric boiling point between 10 and 50° C. and (iii) a molecular weight of less than 219, the co-solvent being present in the spin fluid in an amount sufficient to raise the cloud point pressure of the spin fluid by at least 50 pounds per square inch; and flash-spinning the spin fluid at a pressure that is greater than the autogenous pressure of the spin fluid into a region of lower pressure to form plexifilamentary film-fibril strands of the synthetic fiber forming polyolefin.

DETAILED DESCRIPTION OF THE INVENTION

Figure 1:
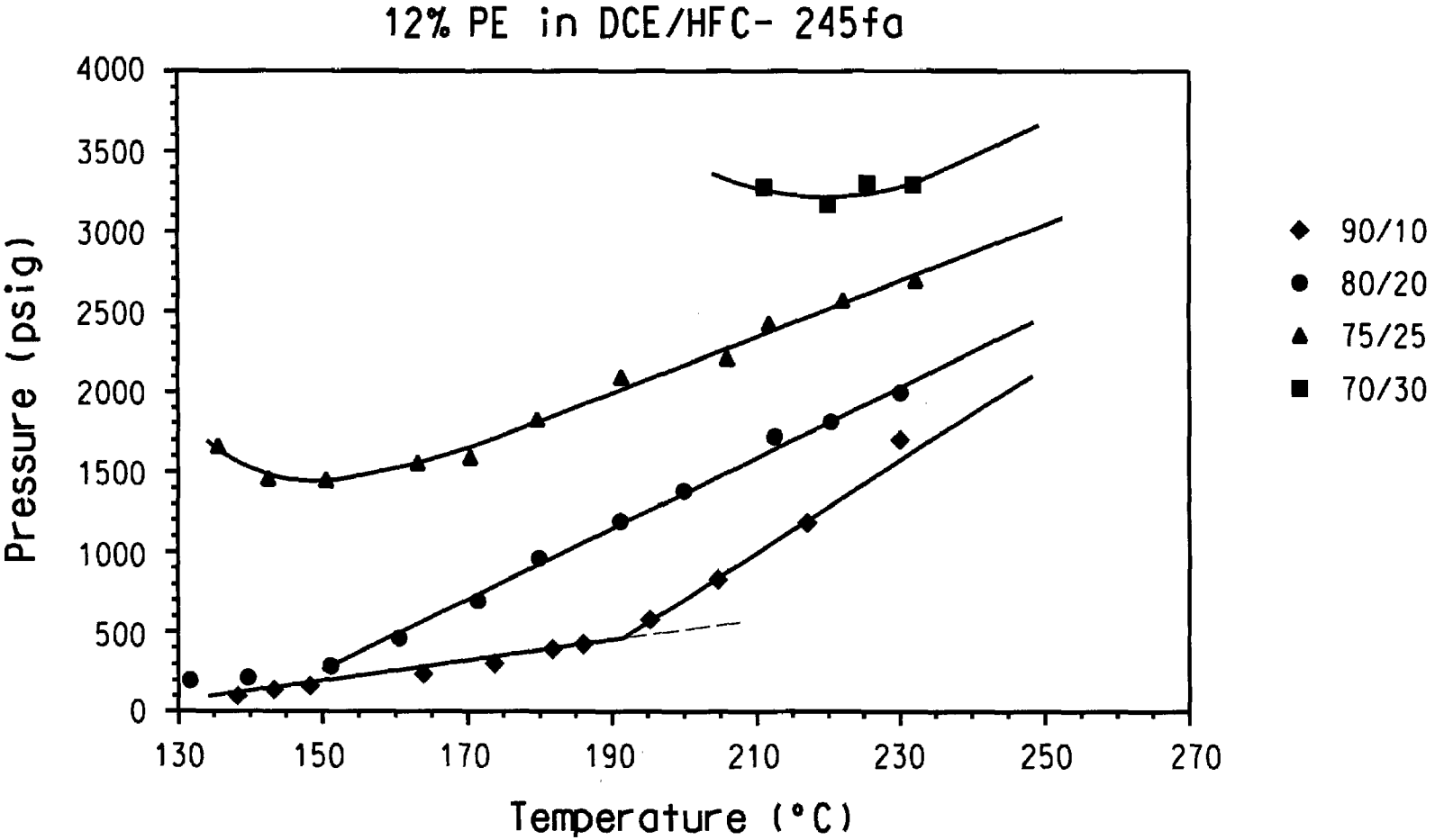
FIGS. 1-5 are plots of the cloud point data for a solution of 12% by weight high-density polyethylene in a solvent of either dichloromethane or 1,2 dichloroethylene with a cosolvent of either 1,1,1,3,3-pentafluoropropane, 1,1,2,2,3,3,4,4-octafluorobutane or 1,1,1,3,3-pentafluorobutane.
Figure 2:
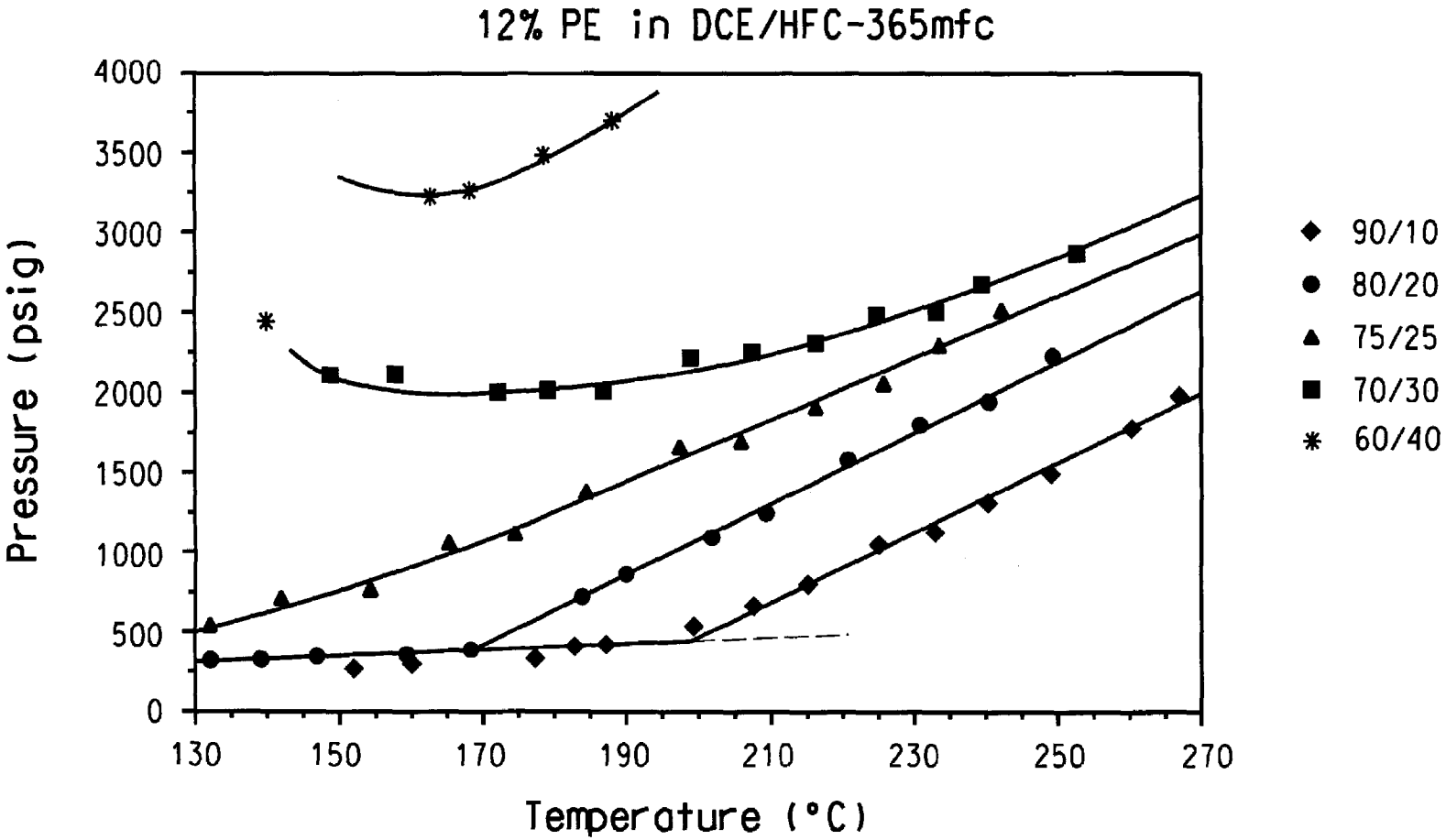
Figure 3:
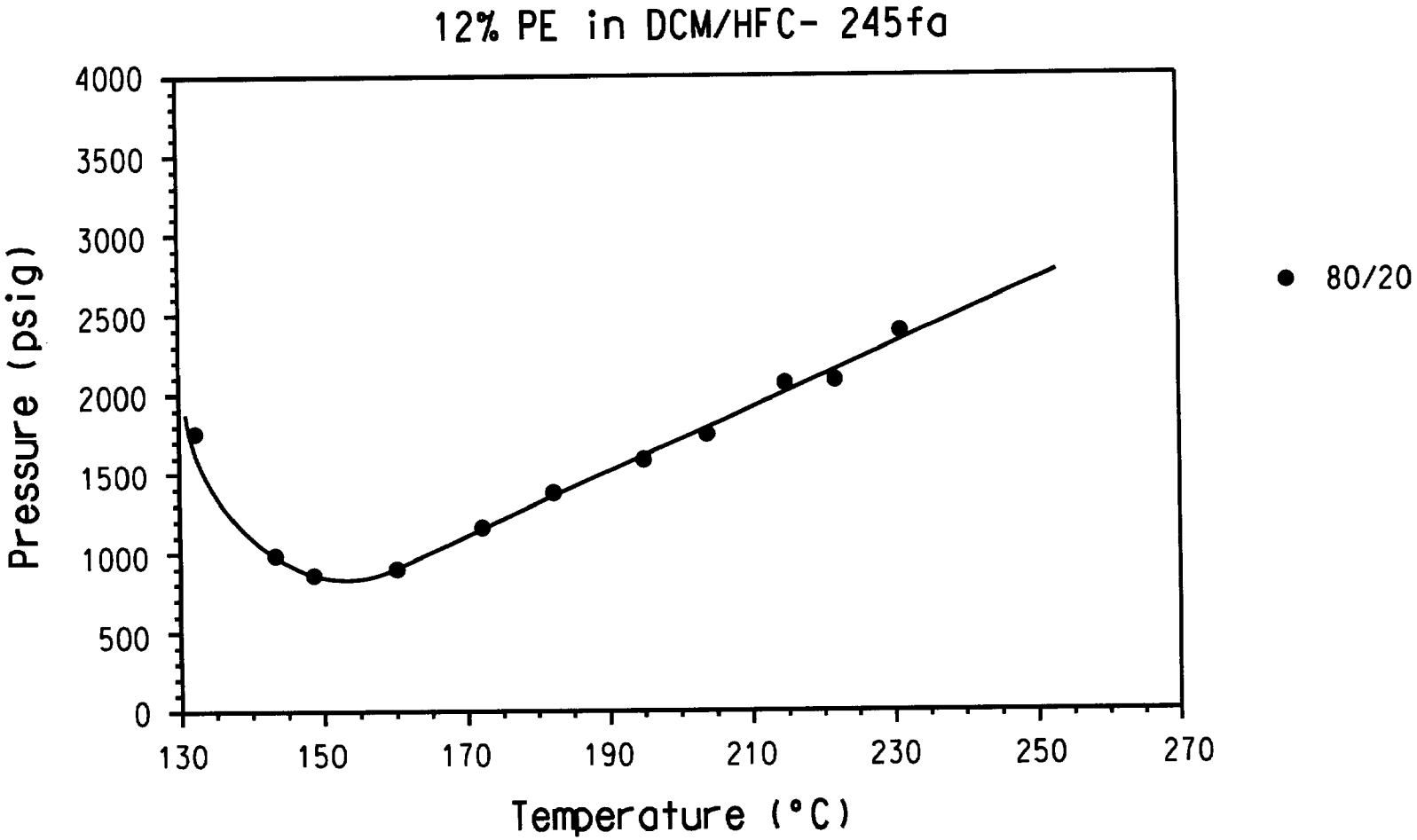
Figure 4:
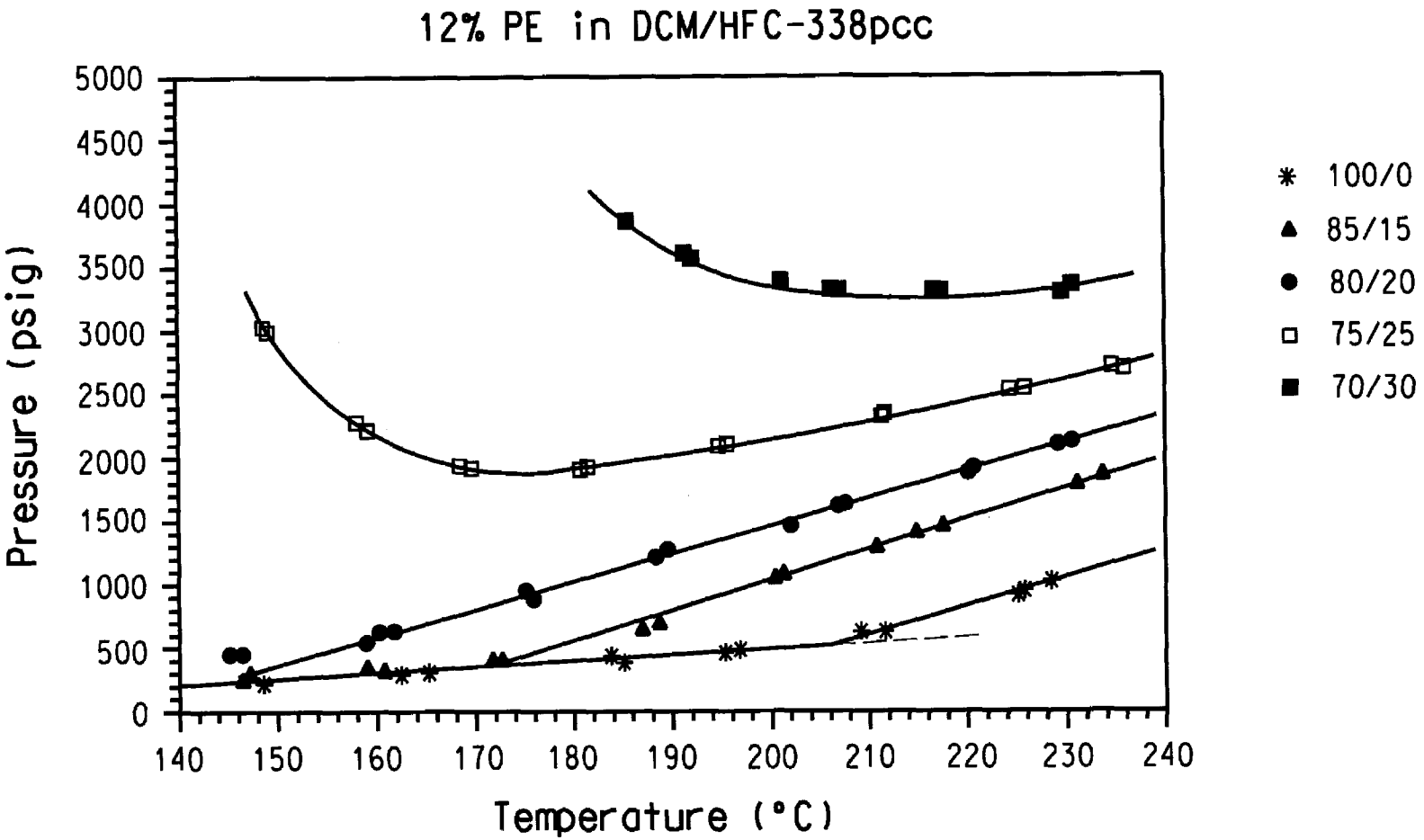
Figure 5:
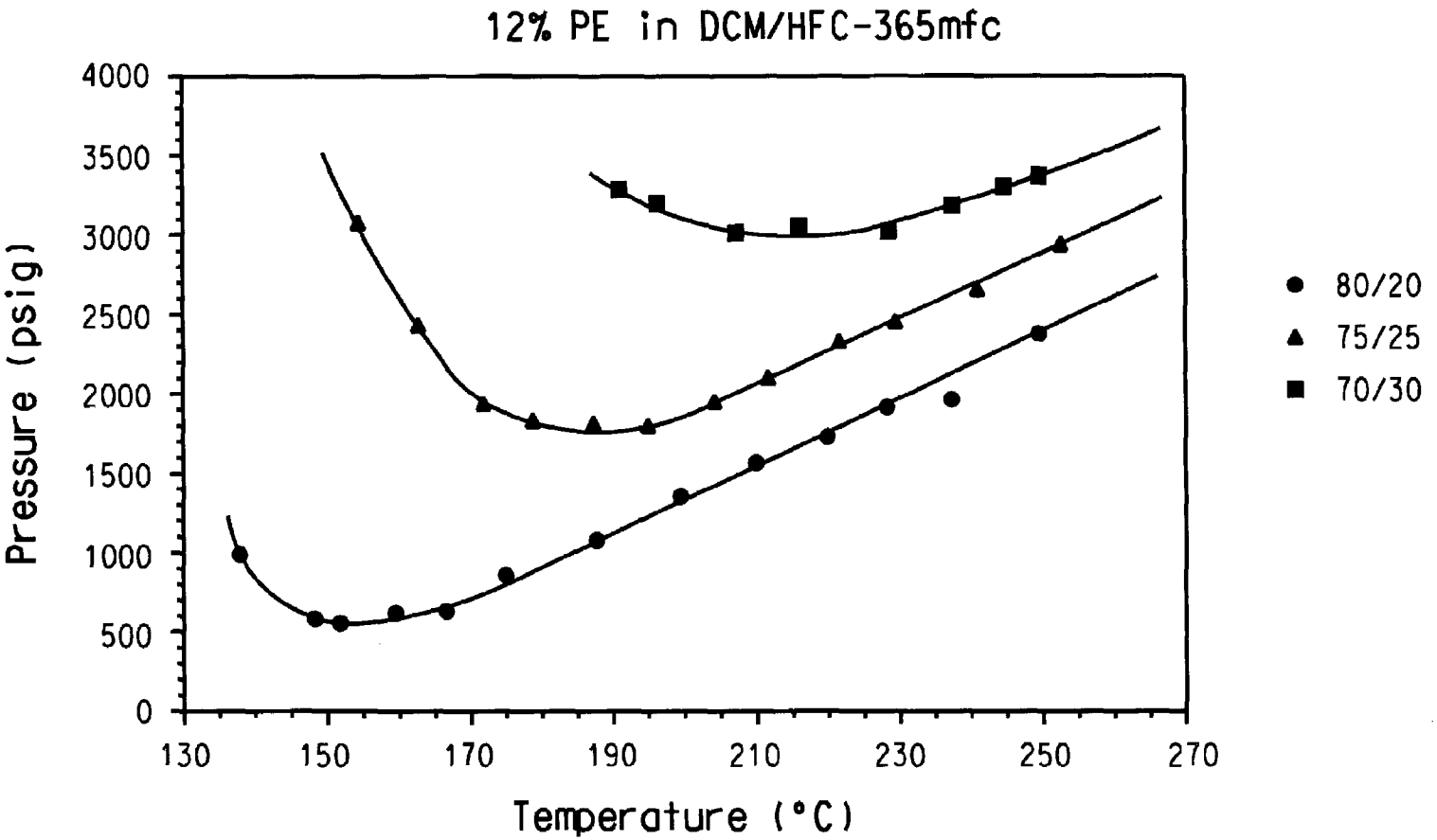
Figure 6:
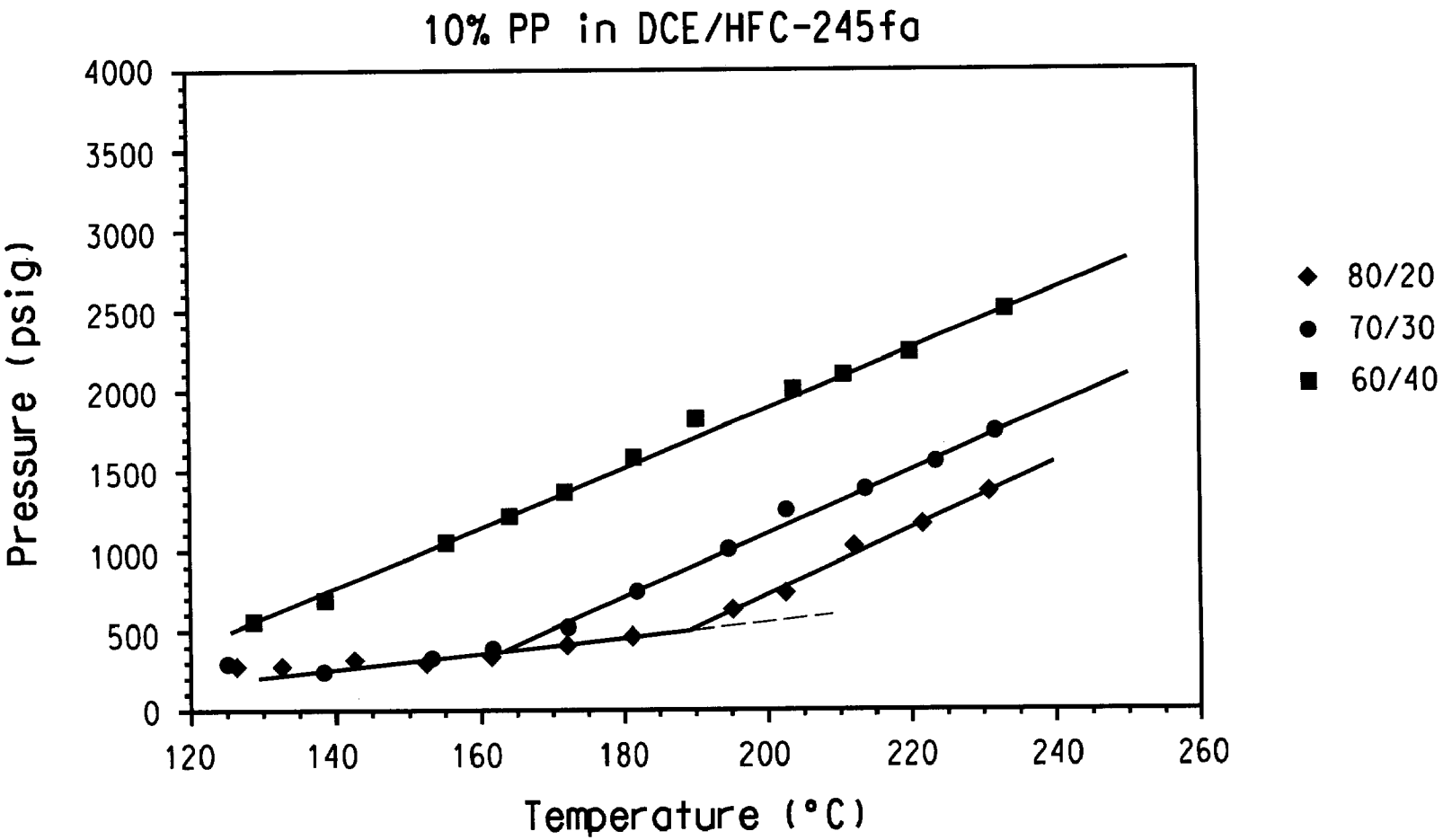
FIGS. 6-9 are plots of the cloud point data for a solution of 10% by weight polypropylene in a solvent of either dichloromethane or 1,2 dichloroethylene with a cosolvent of either 1,1,1,3,3-pentafluoropropane or 1,1,1,3,3-pentafluorobutane.
Figure 7:
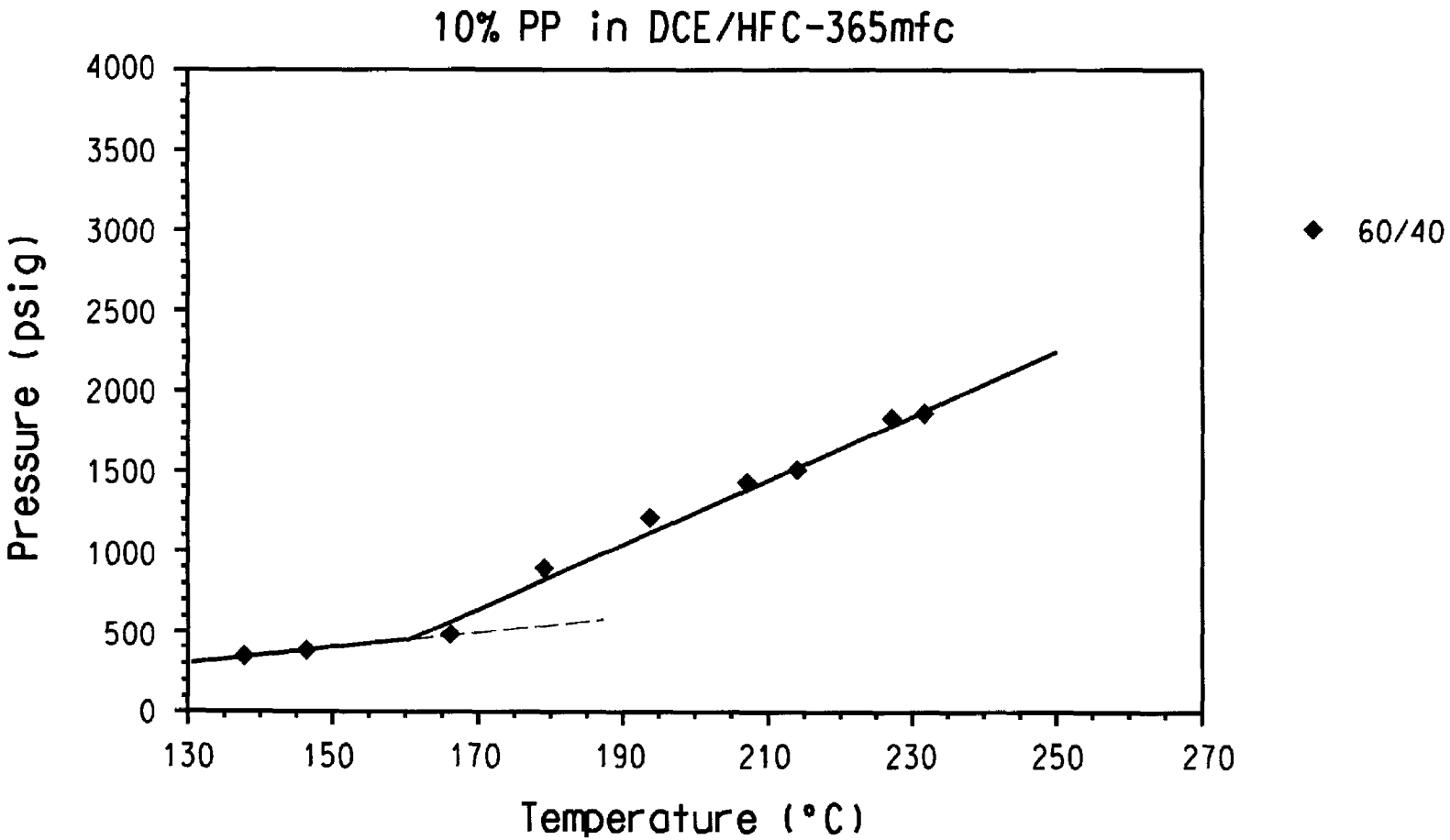
Figure 8:
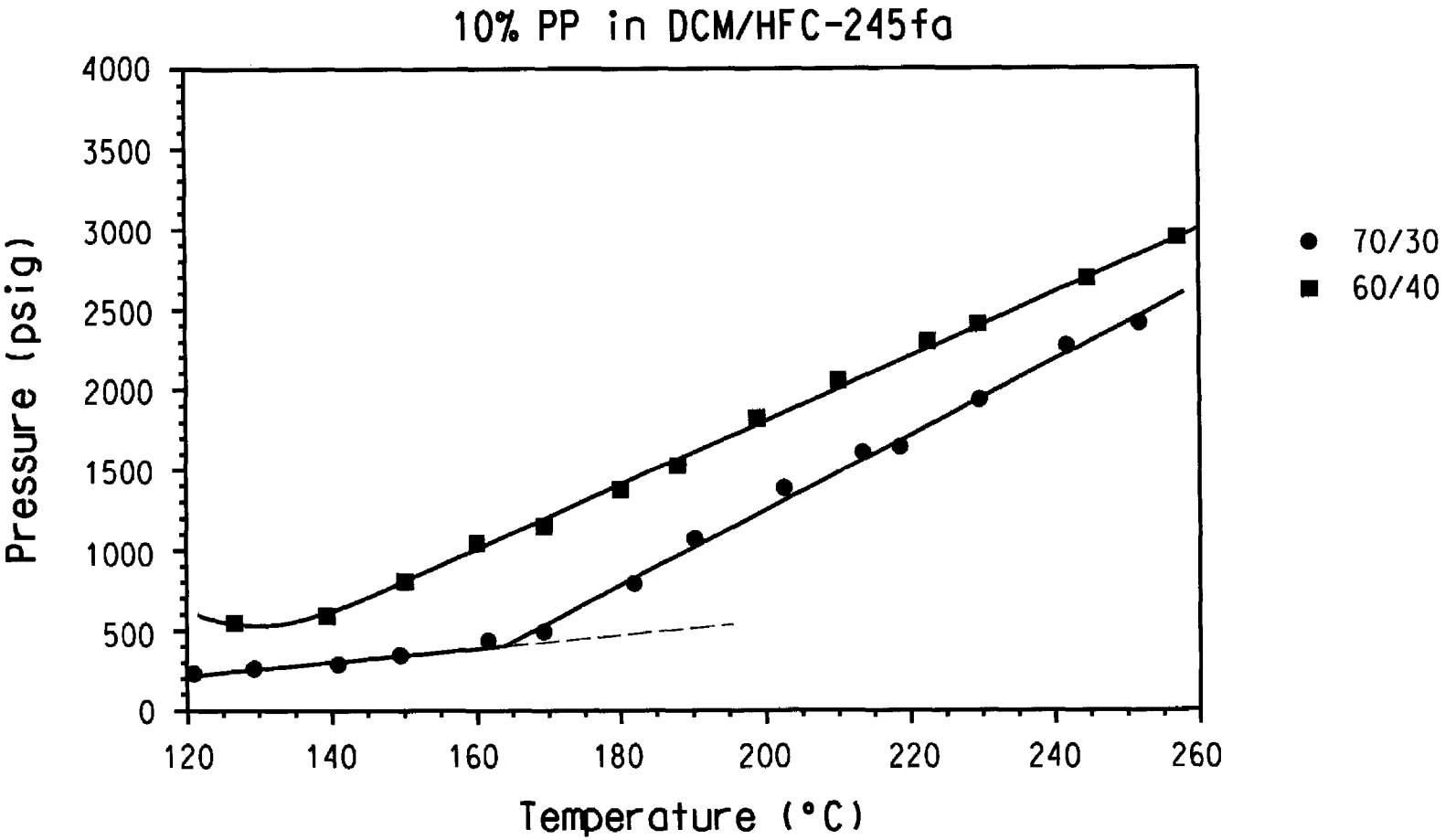
Figure 9:
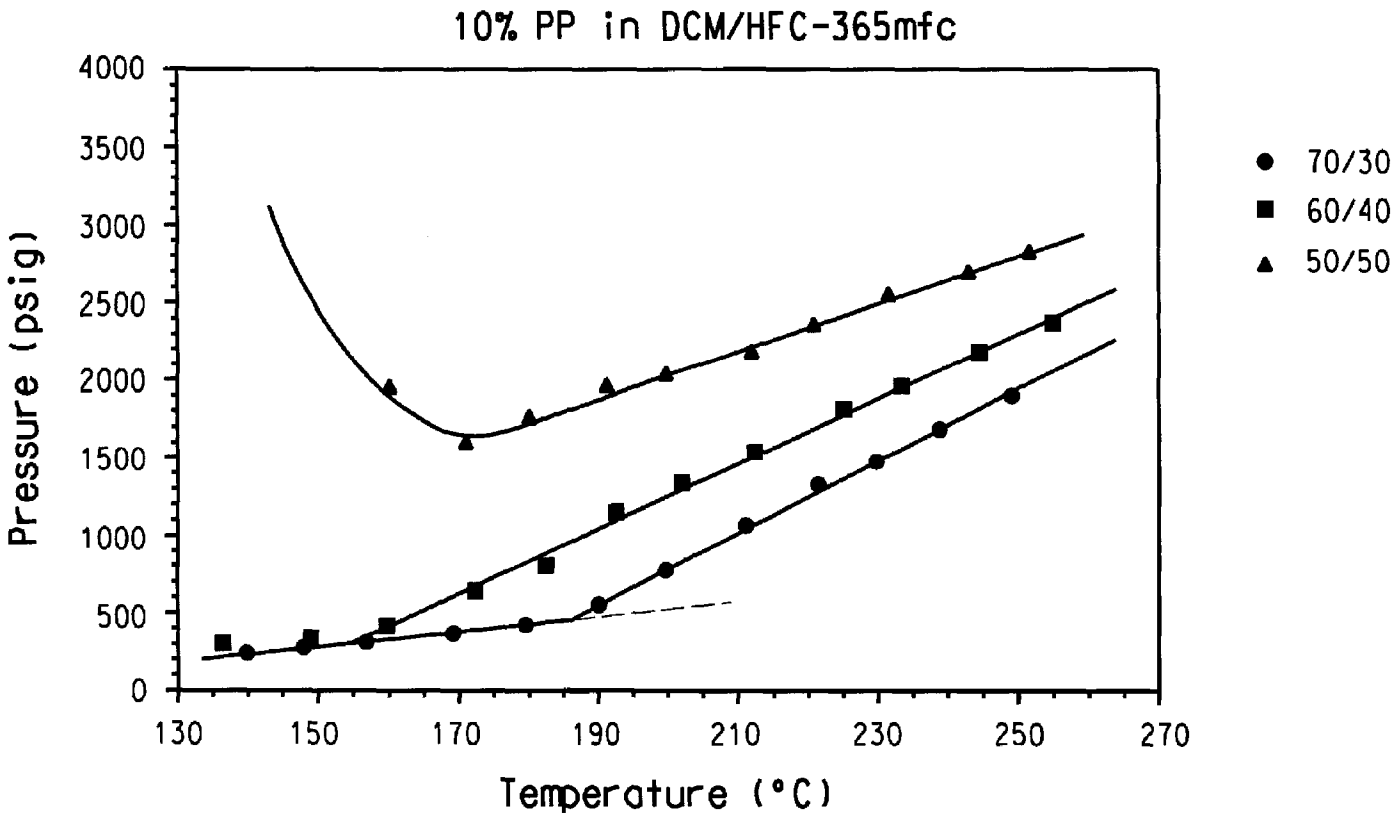
Figure 10:
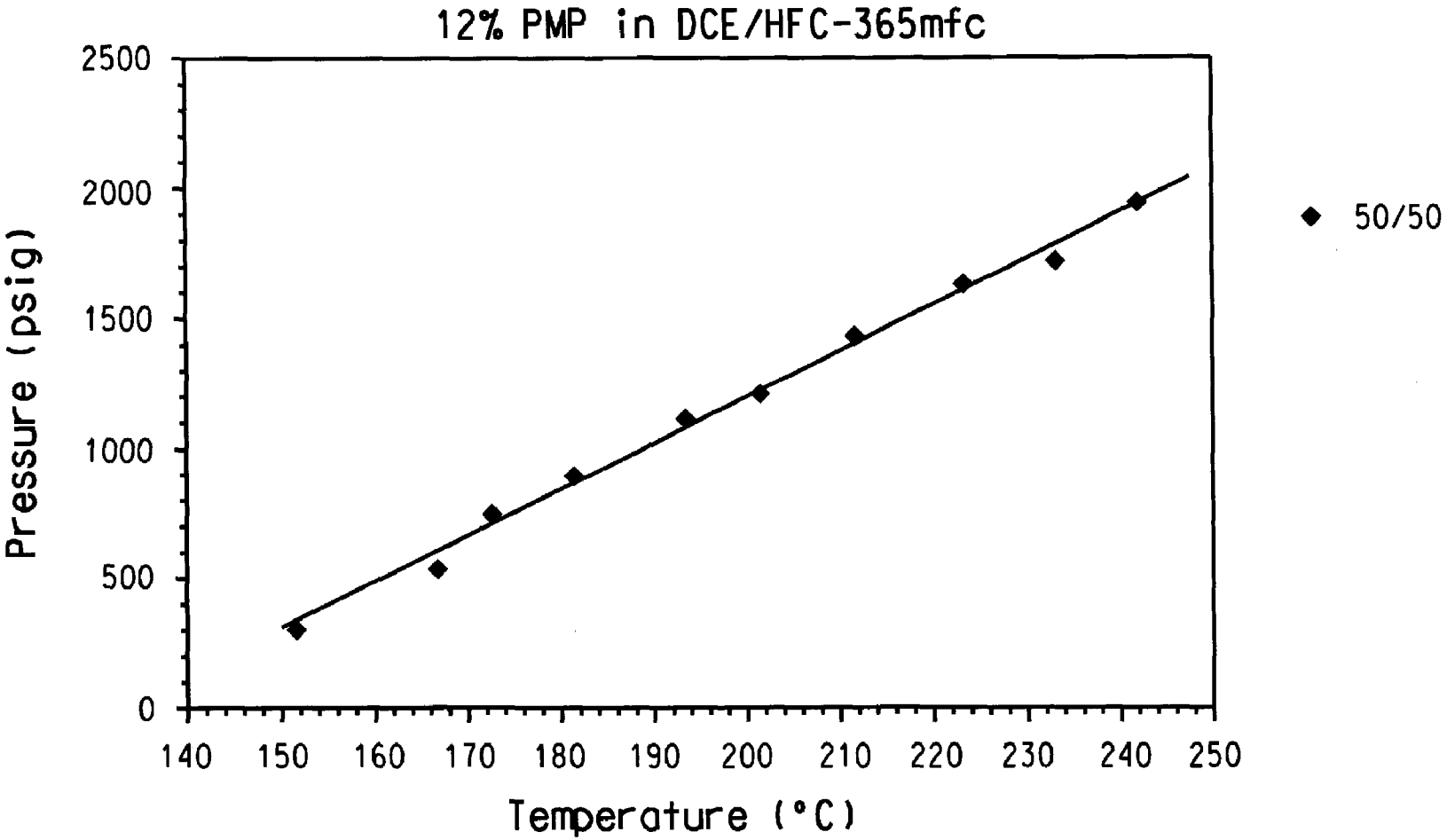
FIG. 10 is a plot of the cloud point data for a solution of 12% by weight of polymethylpentene in a solvent of 1,2 dichloroethylene with a cosolvent of 1,1,1,3,3-pentafluorobutane.
Figure 11:
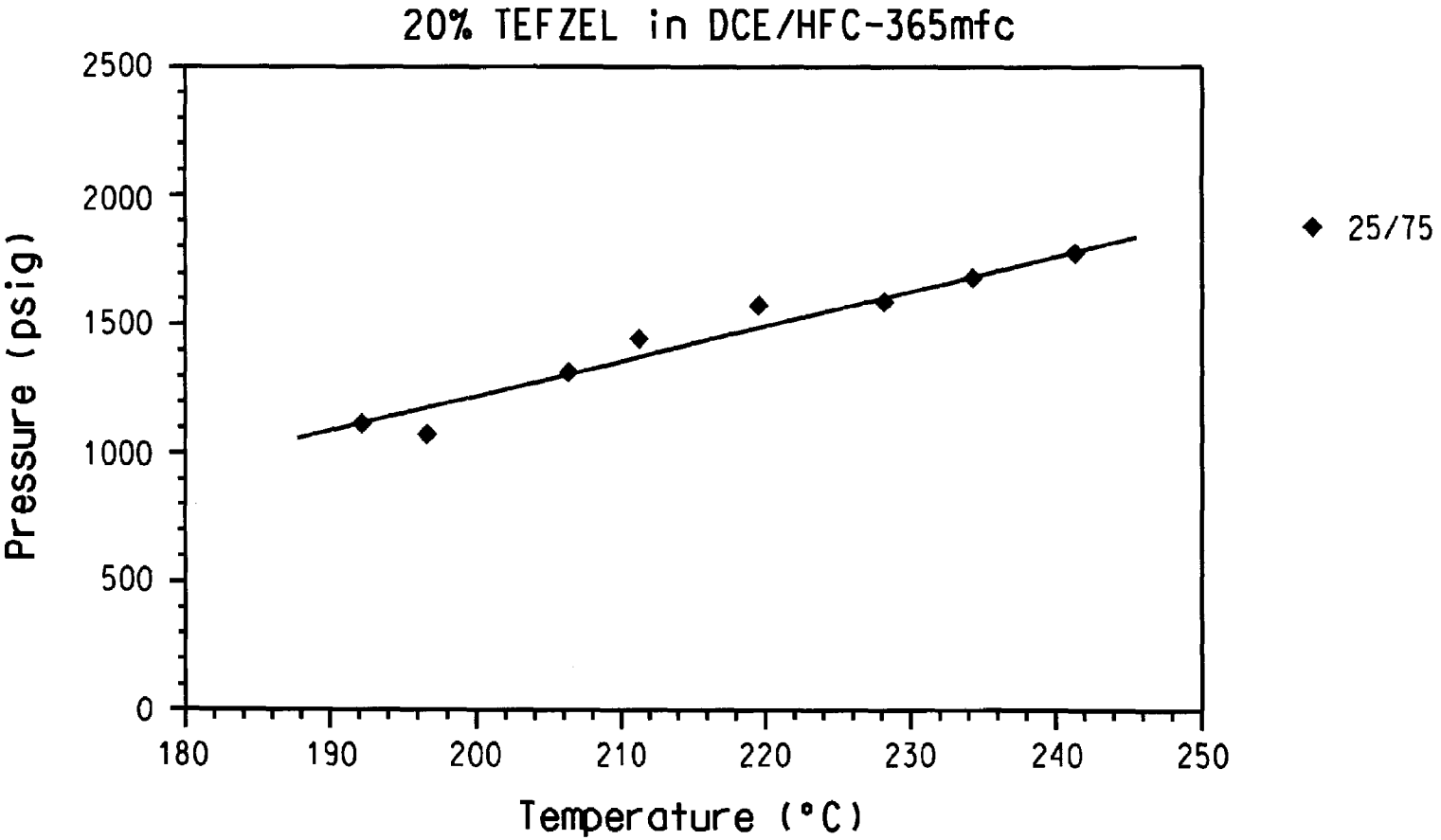
FIGS. 11-13 are plots of the cloud point data for a solution of 20% by weight of TEFZEL® in a solvent of either dichloromethane or 1,2 dichloroethylene with a cosolvent of either 1,1,1,3,3-pentafluoropropane, or 1,1,1,3,3-pentafluorobutane.
Figure 12:
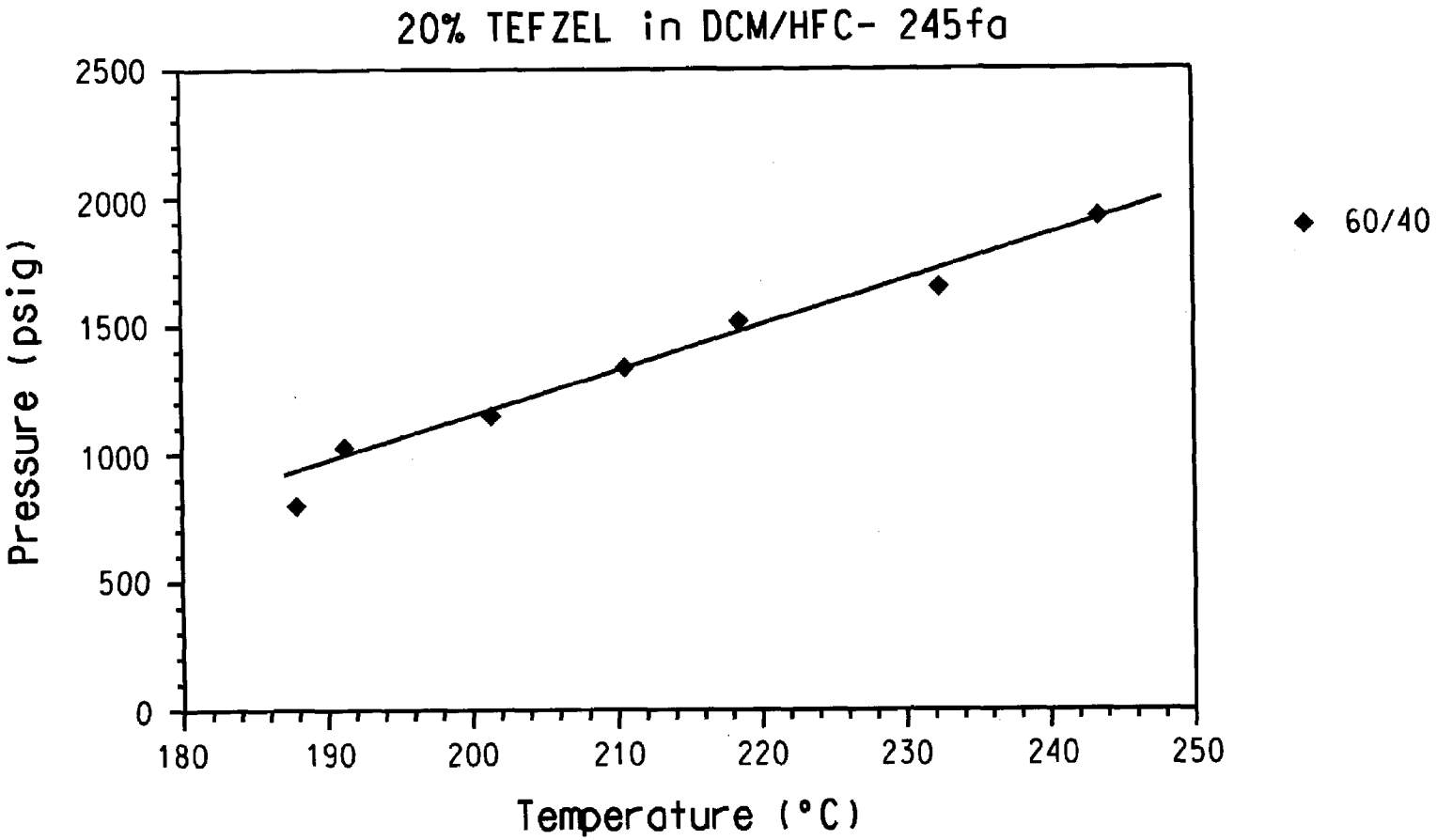
Figure 13:
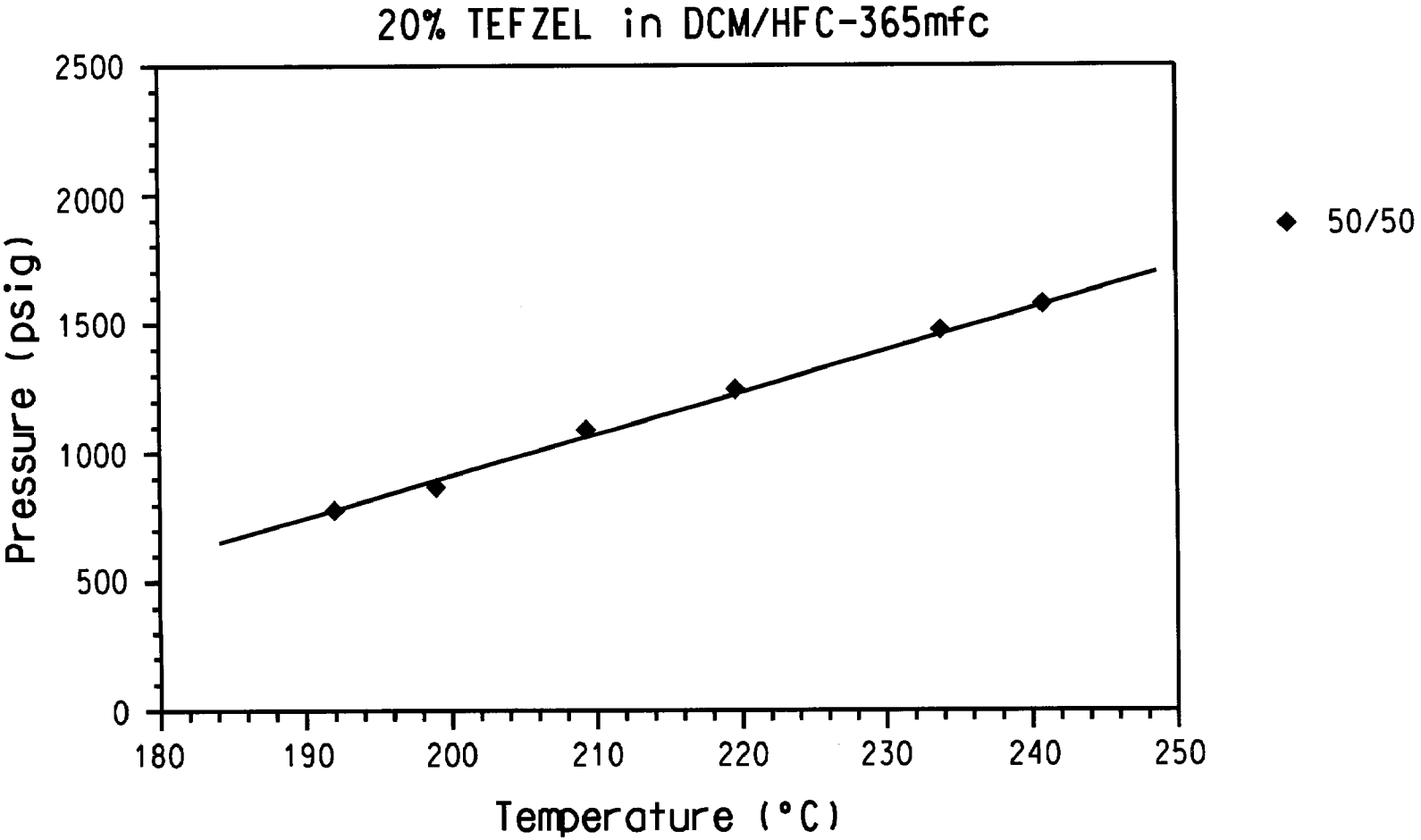
Figure 14:
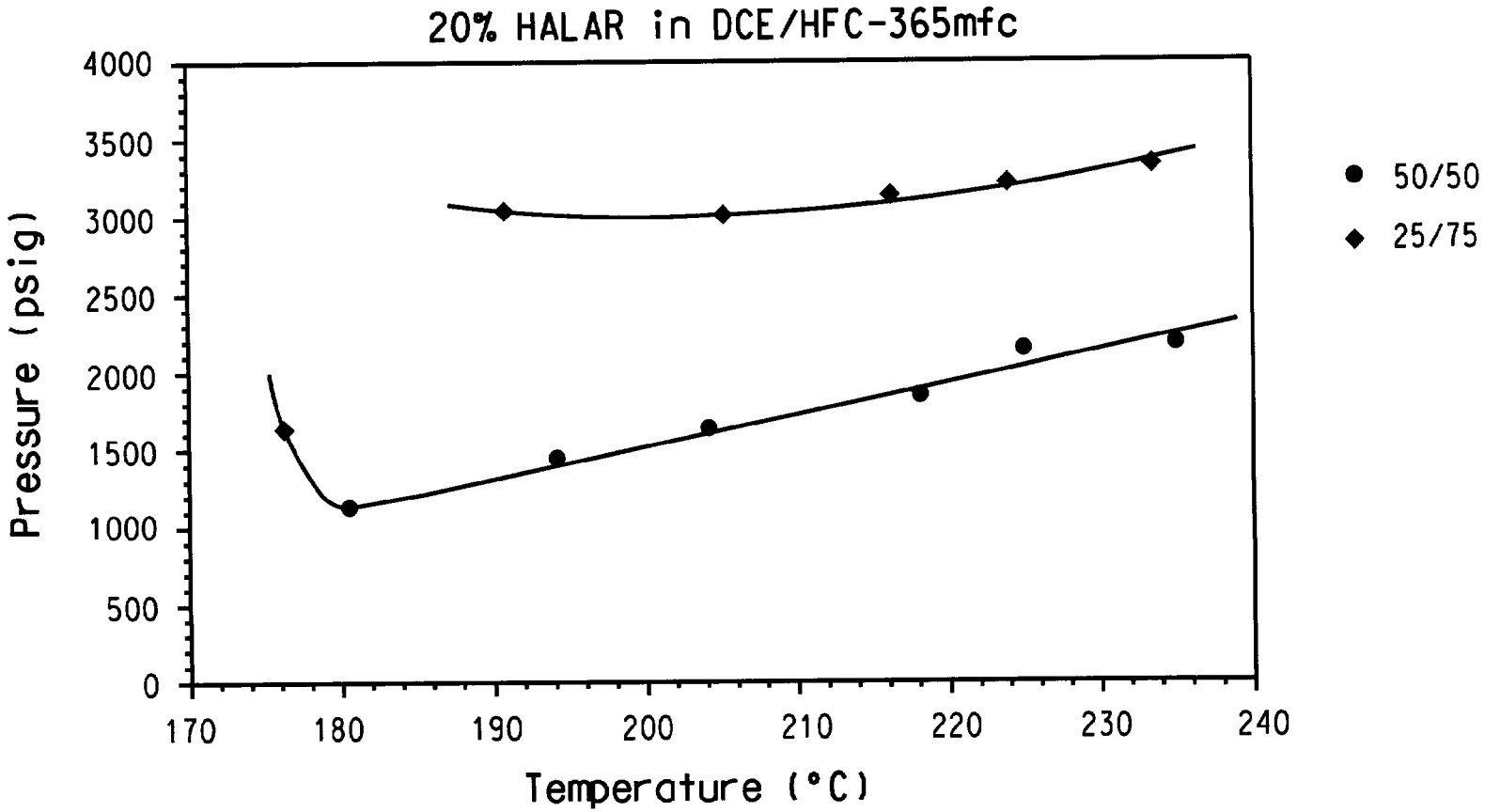
FIG. 14 is a plot of the cloud point data for a solution of 20% by weight of HALAR® in a solvent of 1,2 dichloroethylene with a cosolvent of 1,1,1,3,3-pentafluorobutane.
Figure 15:
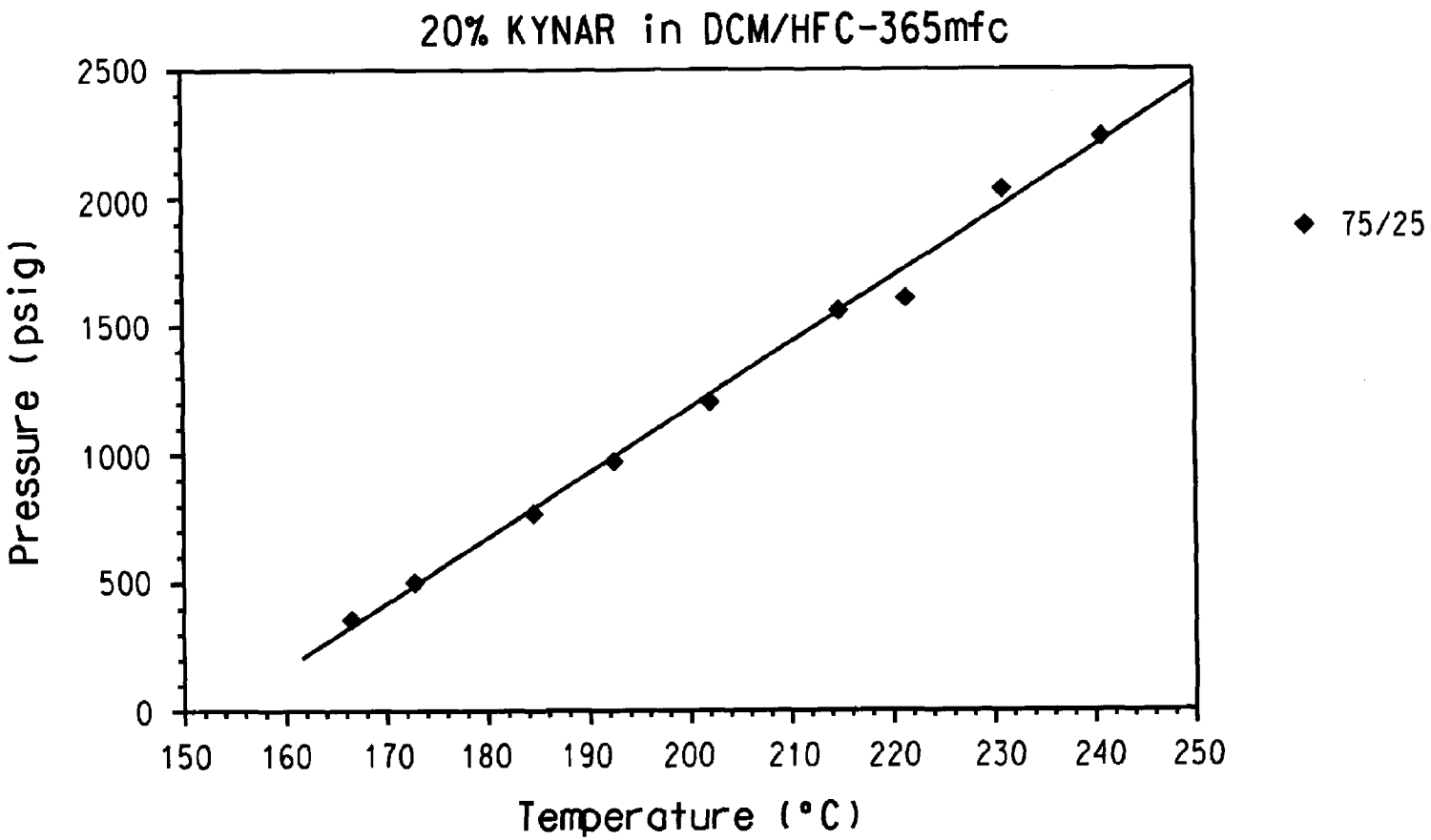
FIG. 15 is a plot of the cloud point data for a solution of 20% by weight of KYNAR® in a solvent of dichloromethane with a cosolvent of 1,1,1,3,3-pentafluorobutane.

The term "synthetic fiber-forming polyolefin" is intended to encompass the classes of polymers found to be suitable for use in the flash-spinning art. It is further noted that the term is intended herein to include partially fluorinated polymers.

The term "polyethylene" as used herein is intended to encompass not only homopolymers of ethylene, but also copolymers wherein at least 85% of the recurring units are ethylene units. One preferred polyethylene is high-density polyethylene which has an upper limit of melting range of about 130 to 140° C., a density in the range of 0.94 to 0.98 gram per cubic centimeter, and a melt index (MI) of between 0.1 and 100, preferably less than 4.

The term "polypropylene" is intended to embrace not only homopolymers of propylene but also copolymers where at least 85% of the recurring units are propylene units. Isotactic and syndiotactic polypropylene are preferred forms.

The term "cloud-point pressure" as used herein, means the pressure at which a single-phase liquid solution starts to phase separate into a polymer-rich/spin agent-rich two-phase liquid/liquid dispersion.

To raise the cloud-point pressure the co-solvent in the spin fluid must be a "non-solvent" for the polymer, or at least a poorer solvent than the primary solvent, i.e., dichloromethane or 1,2-dichloroethylene.

Dichloromethane (DCM) and 1,2-dichloroethylene (DCE) are examples of such good solvents for the polyolefins (e.g., polyethylene and polypropylene) that are commercially available. However, their cloud-point pressures are so close to the bubble point that it is not considered feasible to use them alone as spin agents. By employing one of the following co-solvents, the solvent power of the mixture is lowered sufficiently so that flash spinning to obtain the desired plexifilamentary product is readily accomplished. HFC-245fa ($CF_3CH_2CHF_2$ or 1,1,1,3,3-pentafluoropropane) has a molecular weight of 134, a boiling point of 15.3 C and no flash point or explosive limit. HFC-338pcc ($CHF_2CF_2CF_2CHF_2$ or 1,1,2,2,3,3,4,4-octofluorobutane) has a molecular weight of 202, a boiling point of 38.5° C. and no flash point or explosive limit. HFC-365mfc ($CF_3CH_2CF_2CH_3$ or 1,1,1,3,3-pentafluorobutane) has a molecular weight of 148, a boiling point of 40.2° C., no flash point and an explosive limit of 3.5-9.0. Considering that DCE and DCM have low flammability as do the co-solvents, the solvent mixtures of the present invention would exhibit virtually no flammability or very low flammability. Also, because the solvent mixtures have boiling points near room temperature, neither a high-pressure solvent recovery system nor a high-pressure solvent injection system is necessary.

In order to spread the web formed when polymers are flash spun in the commercial operations, the flash spun material is projected against a rotating baffle (as disclosed in U.S. Pat. No. 3,851,023 to Brethauer et al.) and then subjected to an electrostatic charge. The baffle causes the product to change directions and start to spread, and the electrostatic charge causes the product (web) to further spread. In order to achieve a satisfactory commercial product in a commercially acceptable time, it is necessary that the web achieve a significant degree of spread, and this can be achieved only if sufficient electrostatic charge remains on the web for the desired time. The charge will dissipate too rapidly if the atmosphere surrounding the web has too low a dielectric strength. A major component of the atmosphere surrounding the web is the vaporized solvents that, prior to flash spinning, dissolved the polymer that was flash spun. The mixtures of primary solvent dichloromethane or 1,2-dichloroethylene with the co-solvents listed herein, when vaporized, have a dielectric strength sufficient to maintain sufficient electric charge on the web to insure a satisfactory product. These mixtures have a dielectric strength as measured by ASTM D-2477 of greater than about 40 kilovolts per centimeter.

The amount of co-solvent employed with the primary solvent of either dichloromethane or 1,2-dichloroethylene will usually be in the range of about 10 to 80 parts by weight per hundred parts by weight of the solvent mixture.

The polymers to form the plexifilamentary fibers used herein are typically in the amount of 5-30% by weight of the total spin fluid mixture. The polymers include, polyethylene (for example, high density polyethylene (HDPE), available from Equistar; polypropylene available from Basell, (previously known as Himont, and also known as Montell) of Wilmington, Del.); polymethylpentene (for example, TPX available from Mitsui); KYNAR®, a polyvinylidene fluoride available from Atofina); TEFZEL®, a copolymer of ethylene and tetrafluoroethylene available from DuPont and HALAR®, a copolymer of ethylene and chlorotrifluoroethylene resin available from Ausimont.

Test Methods

The strands are conditioned and tested at 70° F. and 65% relative humidity. Denier of the flash-spun strand is determined as follows. One 90-cm long strand of yarn is cut, and a predetermined weight is hung on one end of the yarn for 3 minutes to remove bends and waviness. From the long single yarn strand, five 18-cm individual pieces are cut, and denier is determined for each piece.

The sample is then twisted to 10 turns per inch (tpi) and mounted in the jaws of an Instron tensile testing machine. A 2-inch gauge length and an elongation rate of 100% per minute are used. The tenacity (ten) at break is recorded in grams per denier (gpd). Modulus (mod) corresponds to the slope of the stress/strain curve and is expressed in units of gpd.

Elongation of the flash-spun strand is measured as elongation at break and is reported as a percentage.

The determinations of MFR or MI for the various polymers were conducted in accordance with ASTM D-1238, except for Example 12, wherein the MFR was conducted in accordance with ASTM D-3159.

EXAMPLES

The spinning apparatus used in the Examples is described in U.S. Pat. No. 5,250,237 to Shin et al at column 10 and following. The apparatus consists of two high-pressure cylindrical chambers, each equipped with a piston which is adapted to apply pressure to the contents of the chamber. The cylinders have an inside diameter of 1.0 inch (2.54 cm) and each has an internal capacity of 50 cubic centimeters. The cylinders are connected to each other at one end through a 3/32-inch (0.23 cm) diameter channel and a mixing chamber containing a series of fine mesh screens that act as a static mixer. Mixing is accomplished by forcing the contents of the vessel back and forth between the two cylinders through the static mixer. A spinneret assembly with a quick-acting means for opening the orifice is attached to the channel through a tee. The spinneret assembly consisted of a lead hole of 0.25 inch (0.63 cm) diameter and about 2.0 inch (5.08 cm) length with a 60 degree entrance angle to the orifice, and a spinneret orifice with a length and a diameter each measuring 30 mils (0.762 mm). The pistons are driven by high-pressure water supplied by a hydraulic system.

In the tests reported in the Examples, the apparatus described above was charged with the applicable polymer pellets and the spin agent. High-pressure water was used to drive the pistons to generate a mixing pressure (back pressure) of approximately 2000 psig (13790 kPa gage). The polymer and spin agent were then heated to the mixing temperature, during which time the pistons were used to alternately establish a differential pressure ($\Delta P$) between the two cylinders so as to repeatedly force the polymer and spin agent through the mixing channel from one cylinder to the other to provide mixing and to effect formation of a spin fluid. In the examples below, the $\Delta P$ values were all approximately 300 psi (2068 kPa). The spin fluid temperature was then adjusted to the final spin temperature and held there for about 15 minutes or longer to equilibrate the temperature, during which time mixing was continued. In order to simulate a pressure letdown chamber, the pressure of the spin fluid was reduced to a desired spinning pressure just prior to spinning. This was accomplished by opening a valve between the spin cell and a much larger tank of high-pressure water ("the accumulator") held at the desired spinning pressure. The spinneret orifice is opened as rapidly as possible after the opening of the valve between the spin cell and the accumulator. The spinneret employed had an orifice with 30-mil diameter and a 30-mil length (30 mil=0.030 inches=0.0762 cm). This generally takes about one second. This is intended to simulate the letdown chamber effect that is used in larger scale spinning operations. The resultant flash-spun product was collected in a stainless steel open mesh screen basket. The pressure recorded just before the spinneret using a computer during spinning is entered as the spin pressure.

It is noted that pressures may be expressed as psig (pounds per square inch gage) which is approximately 15 psi less than psia (pound per square inch absolute). The unit psi is considered the same as psia. For converting to SI units, 1 psi=6.9 kPa.

The polymers used were as follows:

Examples 1-5, polyethylene having an MI of 0.75;

Examples 6-8, polypropylene having an MFR of 1.43;

Examples 9-11, TEFZEL® having an MFR of 7

Example 12, KYNAR® having an MFR of about 3

Example 13, HALAR® having an MFR of 0.7

Example 14, poly(4-methylpentene-1) having an MFR of 8.

In each example, the amount of polymer is provided as a percentage of the total weight of the spin fluid, which includes the polymer, the primary solvent and the co-solvent. The process conditions and the physical properties of the resultant plexifilamentary fibers as flash-spun are presented in the following table. In the table, the primary solvent (i.e., DCM or DCE) is designated as S1 and the co-solvent is designated as S2.

| | SOLVENT | | | MIXING | | | SPIN | | | PROPERTIES @ 10 tpi | | | | |
|---|---|---|---|---|---|---|---|---|---|---|---|---|---|---|
| Example Number | S1 | S2 | S1/S2 wt % | Temp ° C. | Time Min | P psig | Accum.P psig | Spin P psig | Spin T ° C. | gms load | Den | Mod gpd | Ten gpd | E % |
| 1 | DCE | HFC 365 | 75/25 | 190 | 15 | 2000 | 1300 | 1107 | 190 | 100 | 187 | 20.1 | 4.04 | 45.4 |
| 2 | DCM | HFC 365 | 80/20 | 190 | 15 | 2000 | 1000 | 738 | 192 | 100 | 227 | 21.8 | 4.83 | 42.1 |
| 3 | DCE | HFC 245 | 80/20 | 190 | 15 | 2000 | 1000 | 906 | 190 | 100 | 186 | 21.7 | 5.07 | 49.6 |
| 4 | DCM | HFC 245 | 70/30 | 190 | 15 | 2000 | 1300 | 1094 | 190 | 100 | 237 | 14 | 4.16 | 56.6 |
| 5 | DCM | HFC 338 | 80/20 | 200 | 60 | 2000 | 900 | 800 | 198 | 100 | 178 | 23.6 | 5.13 | 58 |
| 6 | DCE | HFC 245 | 70/30 | 210 | 15 | 2000 | 1100 | 948 | 211 | 20 | 142 | 2.5 | 1.06 | 111 |
| 7 | DCM | HFC 365 | 60/40 | 210 | 15 | 2000 | 1300 | 1135 | 211 | 50 | 176 | 5.22 | 1.54 | 144 |
| 8 | DCM | HFC 365 | 60/40 | 210 | 10 | 2000 | 1750 | 1560 | 212 | 20 | 225 | 3.9 | 2.18 | 72.3 |
| 9 | DCM | HFC 365 | 50/50 | 210 | 10 | 2000 | 900 | 722 | 212 | 50 | 236 | 10.4 | 1.98 | 20.5 |
| 10 | DCM | HFC 245 | 60/40 | 210 | 10 | 2000 | 1200 | 921 | 211 | 50 | 442 | 7.03 | 1.38 | 19.4 |
| 11 | DCE | HFC 365 | 25/75 | 210 | 10 | 2000 | 1250 | 1021 | 211 | 50 | 360 | 4.7 | 1.05 | 25.6 |
| 12 | DCM | HFC 365 | 75/25 | 210 | 10 | 2000 | 1200 | 1054 | 211 | 50 | 350 | 5.28 | 2.27 | 43.5 |
| 13 | DCE | HFC 365 | 50/50 | 210 | 11 | 2000 | 1750 | 1452 | 211 | 20 | 839 | 4.94 | 1.03 | 20.8 |
| 14 | DCE | HFC 365 | 50/50 | 240 | 5 | 2000 | 1700 | 1519 | 240 | 10 | 223 | 3.26 | 1.2 | 38.3 |

What is claimed is:

1. A spin fluid comprising:

(a) 5 to 30 wt. % synthetic fiber-forming polyolefin, (b) a primary solvent selected from the group consisting of dichloromethane and 1,2-dichloroethylene, and (c) a co-solvent selected from the group consisting of straight chain hydrofluorocarbons having (i) 3 to 4 carbon atoms, (ii) an atmospheric boiling point between 10 and 50° C. and (iii) a molecular weight of less than 219, the co-solvent being present in the spin fluid in an amount sufficient to raise the cloud point pressure of the spin fluid by at least 50 pounds per square inch.

2. The spin fluid of claim 1 containing 10 to 20 wt. % synthetic fiber-forming polyolefin.

3. The spin fluid of claim 1, wherein the co-solvent is selected from the group consisting of 1,1,1,3,3-pentafluoropropane, 1,1,2,2,3,3,4,4-octafluorobutane and 1,1,1,3,3-pentafluorobutane, and their isomers.

4. The spin fluid of claim 1, wherein the synthetic fiber-forming polyolefin is selected from the group consisting of polyethylene, polypropylene, polymethylpentene, polyvinylidene fluoride, copolymer of ethylene and tetrafluoroethylene, and copolymer of ethylene and chlorotrifluoroethylene.

5. The spin fluid of claim 1, wherein the synthetic fiber-forming polyolefin is polyethylene.

6. The spin fluid of claim 1, wherein the synthetic fiber-forming polyolefin Is isotactic polypropylene.

7. The spin fluid of claim 1, wherein the co-solvent is in an amount sufficient to raise the cloud point pressure of the spin fluid by at least 200 pounds per square inch.

8. A process for the preparation of plexifilamentary film-fibril strands of synthetic fiber-forming polyolefin which comprises:

generating a spin fluid of (a) 5 to 30 wt. % synthetic fiber-forming polyolefin, (b) a primary solvent selected from the group consisting of dichloromethane and 1,2-dichloroethylene, and (c) a co-solvent selected from the group consisting of straight chain hydrofluorocarbons having (i) 3 to 4 carbon atoms, (ii) an atmospheric boiling point between 10 and 50° C. and (iii) a molecular weight of less than 219, and the co-solvent being present in the spin fluid in a amount sufficient to raise the cloud point pressure of the spin fluid by at least 50 pounds per square inch, and flash-spinning the spin fluid at a pressure that is greater than the autogenous pressure of the spin fluid into a region of lower pressure to form plexifilamentary film-fibril strands of the synthetic fiber forming polyolefin.

9. The process of claim 8, wherein the co-solvent is selected from the group consisting of 1,1,1,3,3-pentafluoropropane, 1,1,2,2,3,3,4,4-octafluorobutane and 1,1,1,3,3-pentafluorobutane, and their isomers.

10. The process of claim 8, wherein the fiber-forming polyolefin is selected from the group consisting of polyethylene, polypropylene, polymethypentene, polyvinylidene flouride, copolymer of ethylene and tetrafluoroethylene, and copolymer of ethylene and chlorotrifluoroethylene.

11. The process of claim 8, wherein the synthetic fiber-forming polyolefin is polypethylene.

12. The process of claim 8, wherein the synthetic fiber-forming polyolefin is isotactic polypropylene.

13. The process of claim 8, wherein the spin fluid contains 10 to 20 wt. % synthetic fiber-forming polyolefin.

14. The process of claim 8, wherein the co-solvent is present in the spin fluid in an amount sufficient to raise the cloud point pressure of the spin fluid by at least 200 pounds per square inch.

* * * * *